US005577331A

United States Patent [19]

Suzuki

[11] Patent Number: 5,577,331

[45] Date of Patent: Nov. 26, 1996

[54] DOWNFLOW SPIN DRYER

[75] Inventor: Hiromi Suzuki, Tochigi-ken, Japan

[73] Assignee: Nippon Precision Circuits Inc., Tokyo, Japan

[21] Appl. No.: 476,240

[22] Filed: Jun. 7, 1995

[30] Foreign Application Priority Data

Jun. 30, 1994 [JP] Japan ..... 6-149319

[51] Int. Cl.[6] ..... F26B 17/24

[52] U.S. Cl. ..... 34/58; 34/60; 34/61

[58] Field of Search ..... 34/58–61, 63, 34/107–109, 128, 595, 600, 602, 603, 609–10, 147, 184, 186

[56] References Cited

U.S. PATENT DOCUMENTS

| | | | |
|---|---|---|---|
| 4,777,732 | 10/1988 | Hirano | 34/186 |
| 4,907,349 | 3/1990 | Aigo | 34/184 |
| 4,987,687 | 1/1991 | Sugimoto | 34/58 |
| 5,435,075 | 7/1995 | Shiraishi et al. | 34/58 |

FOREIGN PATENT DOCUMENTS 265430 11/1988 Japan .

*Primary Examiner*—Henry A. Bennett
*Assistant Examiner*—Steve Gravini
*Attorney, Agent, or Firm*—Jordan and Hamburg

[57] ABSTRACT

A downflow spin dryer, includes a housing; a rotor rotating within the housing in a direction of rotation, the rotor including first and second opposite mounting holes at different heights; a cradle fitted within the rotor for accommodating semiconductor substrates to be dried, the cradle having a rear portion and a front portion as viewed with respect to the direction of rotation of the rotor, the cradle being fitted to the rotor such that the rear portion of the cradle is at a lower position than the front portion of the cradle, the cradle including first and second opposite mounting holes in alignment with the first and second mounting holes, respectively, of the rotor when the cradle is fitted within the rotor, the first and second mounting holes of the cradle being at the same height; screws for entering the first mounting holes of the cradle and the rotor, and for entering the second mounting holes of the cradle and the rotor, so as to mount the cradle within the rotor; an air inlet in an upper surface of the housing above the rotor through which air is sucked along with the rotation of the rotor; an air outlet in the housing through which air sucked through the air inlet is discharged; and a filter over the air inlet to prevent incursion of dust into the dryer.

13 Claims, 5 Drawing Sheets

| drying time | number of wafers not dry | |
|---|---|---|
| | apparatus of this invention | conventional apparatus |
| 30 sec. | 30 | 50 |
| 1 min. | 2 | 17 |
| 3 min. | 0 | 3 |
| 5 min. | 0 | 0 |

DOWNFLOW SPIN DRYER

BACKGROUND OF THE INVENTION

This invention relates to a downflow-type spin dryer used for drying semiconductor substrates and the like.

Downflow spin dryers are used, for example, for drying wafers in the manufacture of semiconductor chips. In a downflow spin dryer, as shown in FIG. 4, a cradle 41 for accommodating items to be dried is fitted into a rotor 42, the rotor 42 is rotated in the direction of arrow A by driving means (not shown), and the items to be dried are dried by centrifugal force created by the rotation and air sucked in through an air inlet 43 and discharged through an air outlet 44 along with this rotation. A filter is fitted over the entire area of the air inlet 43 to prevent incursion of dust into the dryer, and a cover 45 is fitted to the main unit 46 during drying of the items to be dried.

Part of this downflow spin dryer is shown in the enlarged view of FIG. 5, in which elements which are the same as those in FIG. 4 are denoted by the same reference numerals. When drying wafers, wafers n are accommodated so as to be oriented parallel to the rotational direction A of the rotor 42, as shown in FIG. 5. The cradle 41 is provided with mounting holes 41*a* and 41*b*, and the rotor 42 is provided with mounting holes 42*a* and 42*b*. The mounting holes 41*a* and 42*a* and the mounting holes 41*b* and 42*b* are fixed together, for example, by screws, and the cradle 41 is thereby mounted in the rotor 42.

The cradle 41 is shown mounted in the rotor 42 in FIG. 6. In the state shown in FIG. 6, the rotor 42 rotates. Because the mounting holes 41*a* and 41*b* and the mounting holes 42*a* and 42*b* are respectively disposed at the same height, when the rotor 42 rotates, the cradle 41 and the wafers n rotate parallel to the rotational direction A of the rotor 42.

For loading and removing items to be dried with respect to the cradle 41, the cradle 41 is pivoted through 90° about the mounting holes in the direction of arrow B.

However, in the conventional downflow spin dryer described above, because the cradle 41 is mounted parallel to the rotational direction A of the rotor 42, the wafers n also rotate parallel to the rotational direction A of the rotor. As a result, the amount of air sucked in through the air inlet 43 along with the rotation of the rotor 42 is small and the drying efficiency is not good.

SUMMARY OF THE INVENTION

An object of this invention is to provide a downflow spin dryer in which the amount of air sucked in is great and the drying efficiency is good.

In accordance with the present invention, a downflow spin dryer includes a housing; a rotor rotating within the housing in a direction of rotation; a cradle fitted within the rotor for accommodating items to be dried, the cradle having a rear portion and a front portion as viewed with respect to the direction of rotation of the rotor, the cradle being fitted to the rotor such that the rear portion of the cradle is at a lower position than the front portion of the cradle; an air inlet in the housing through which air is sucked along with the rotation of the rotor; and an air outlet in the housing through which air sucked through the air inlet is discharged.

Preferably, the items to be dried are semiconductor substrates.

The air inlet is in an upper surface of the housing above the rotor.

In a preferred embodiment, the cradle includes first and second opposite mounting holes, the rotor includes first and second opposite mounting holes in alignment with the first and second mounting holes, respectively, of the cradle when the cradle is fitted within the rotor, and screw means are provided for entering the first mounting holes of the cradle and the rotor, and for entering the second mounting holes of the cradle and the rotor, so as to mount the cradle within the rotor.

One way of providing the inclined arrangement is where the first and second mounting holes of the cradle are at the same height, and the first and second mounting holes of the rotor are at different heights.

Another way of providing the inclined arrangement is where the first and second mounting holes of the rotor are at the same height, and the first and second mounting holes of the cradle are at different heights.

In addition, a filter is provided over the air inlet to prevent incursion of dust into the dryer.

The above and other objects, features and advantages of the invention will become readily apparent from the following detailed description thereof which is to be read in connection with the accompanying drawings.

DESCRIPTION OF A PREFERRED EMBODIMENT

A preferred embodiment of the invention will now be described with reference to the accompanying drawings, in which a spin dryer according to the present invention has a different rotor constitution from that of a conventional rotor.

Figure 1:
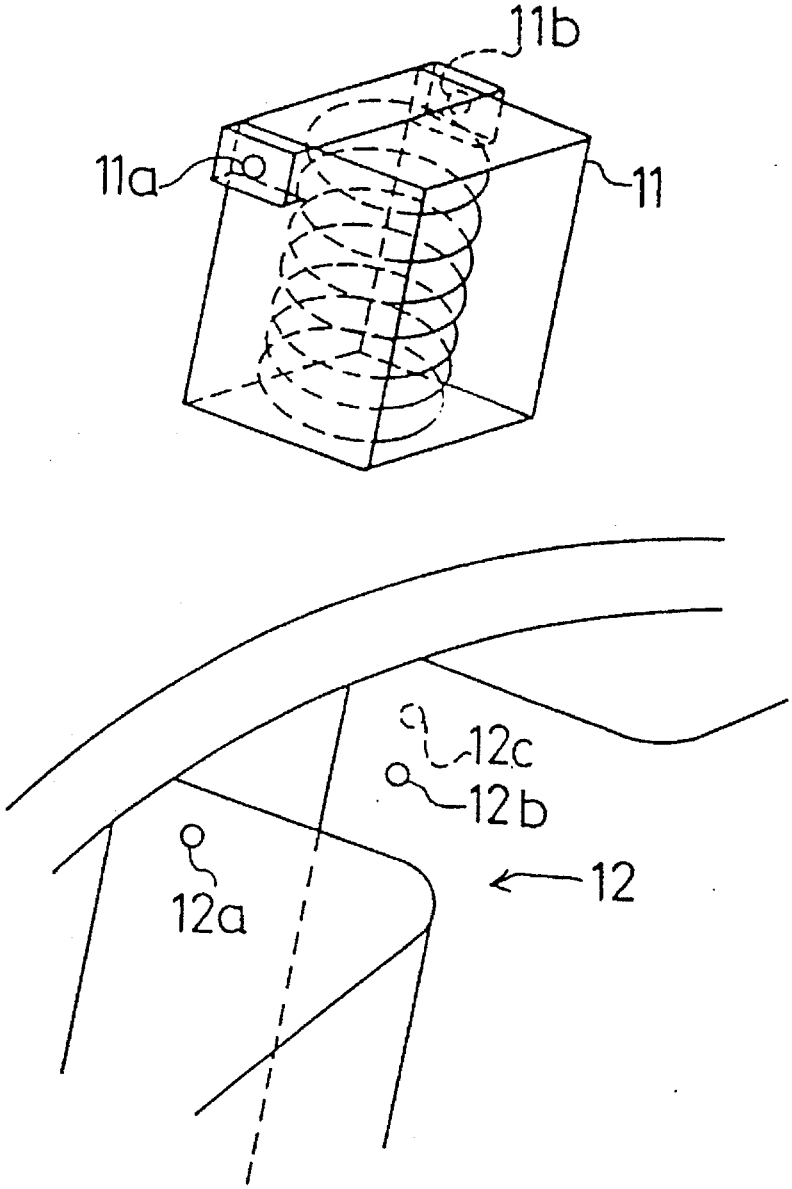
FIG. 1 is an enlarged perspective view of a portion of a downflow spin dryer according to the present invention, with the cradle detached from the rotor.

A main part of a downflow spin dryer according to the present invention is shown in FIG. 1. As shown therein, the spin dryer includes a cradle 11 and a rotor 12. As with a conventional cradle, the cradle 11 is provided with mounting holes 11*a* and 11*b*, both disposed at the same height. The rotor 12 is also provided with mounting holes 12*a* and 12*b*. Reference numeral 12*c* shows the position of a mounting hole provided in a conventional rotor, which is at the same height as the mounting hole 12*a*. However, the mounting hole 12*b* is provided at a lower position than the mounting hole 12*c*, and thereby, also lower than the mounting hole 12*a*. The mounting holes 11*a* and 12*a* and the mounting holes 11*b* and 12*b* are fixed together, for example by screws, and the cradle 11 is thereby mounted in the rotor 12, as shown in FIG. 2.

Figures 2, 3:
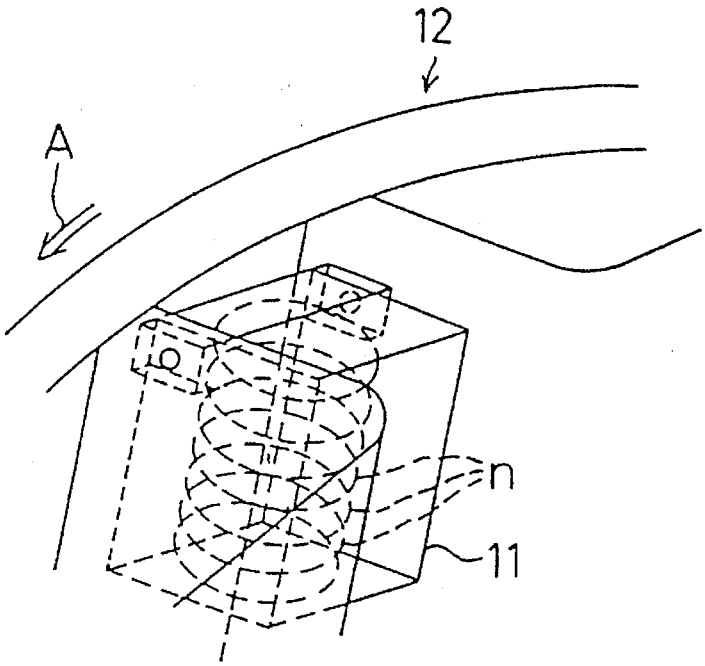
FIG. 2 is an enlarged perspective view of a portion of the downflow spin dryer of FIG. 1, with the cradle mounted in the rotor.
FIG. 3 is a table showing drying times of wafers with a dryer according to the present invention and a conventional dryer.
Figure 4:
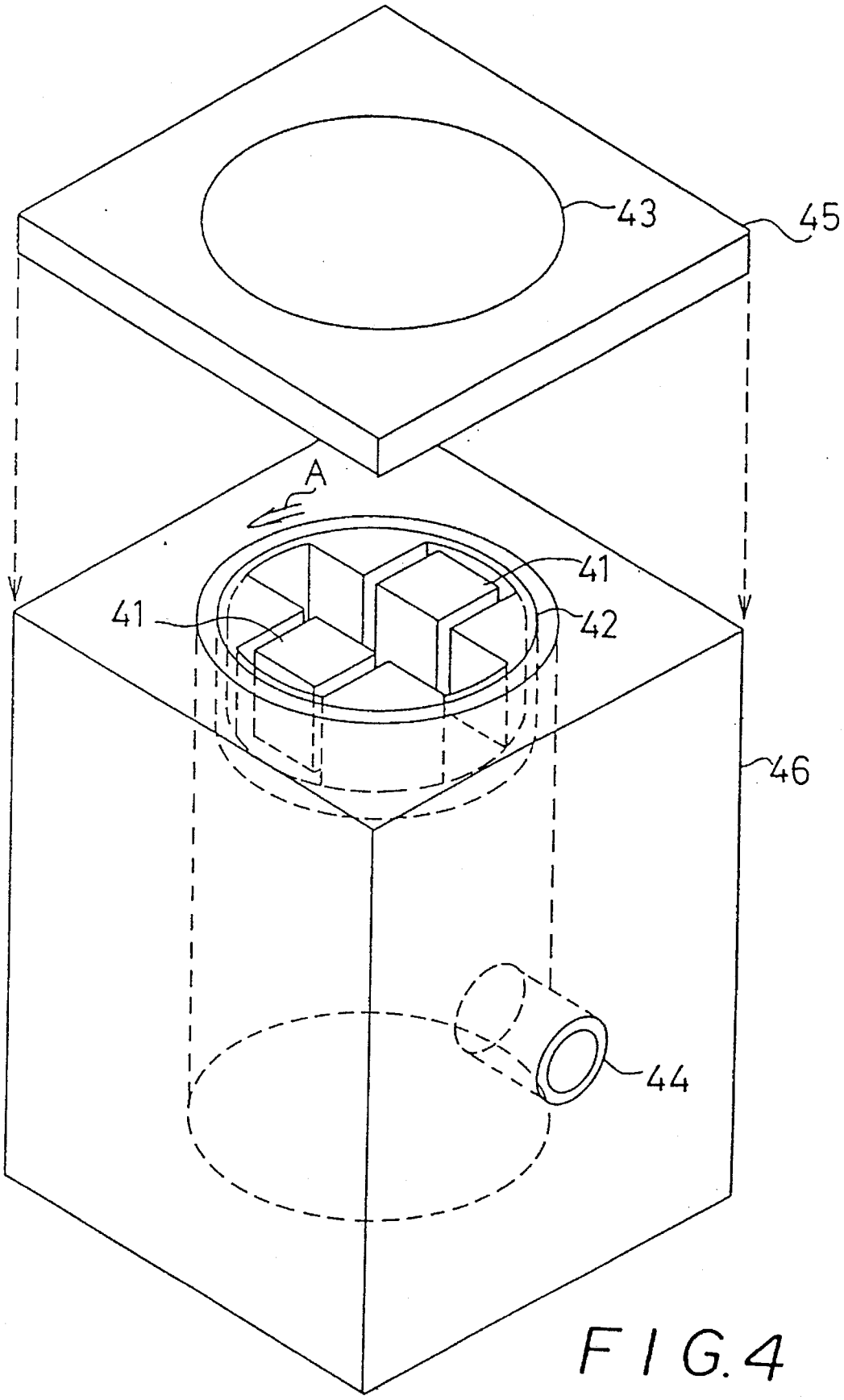
FIG. 4 is a perspective, blown apart view of a known downflow spin dryer.
Figure 5:
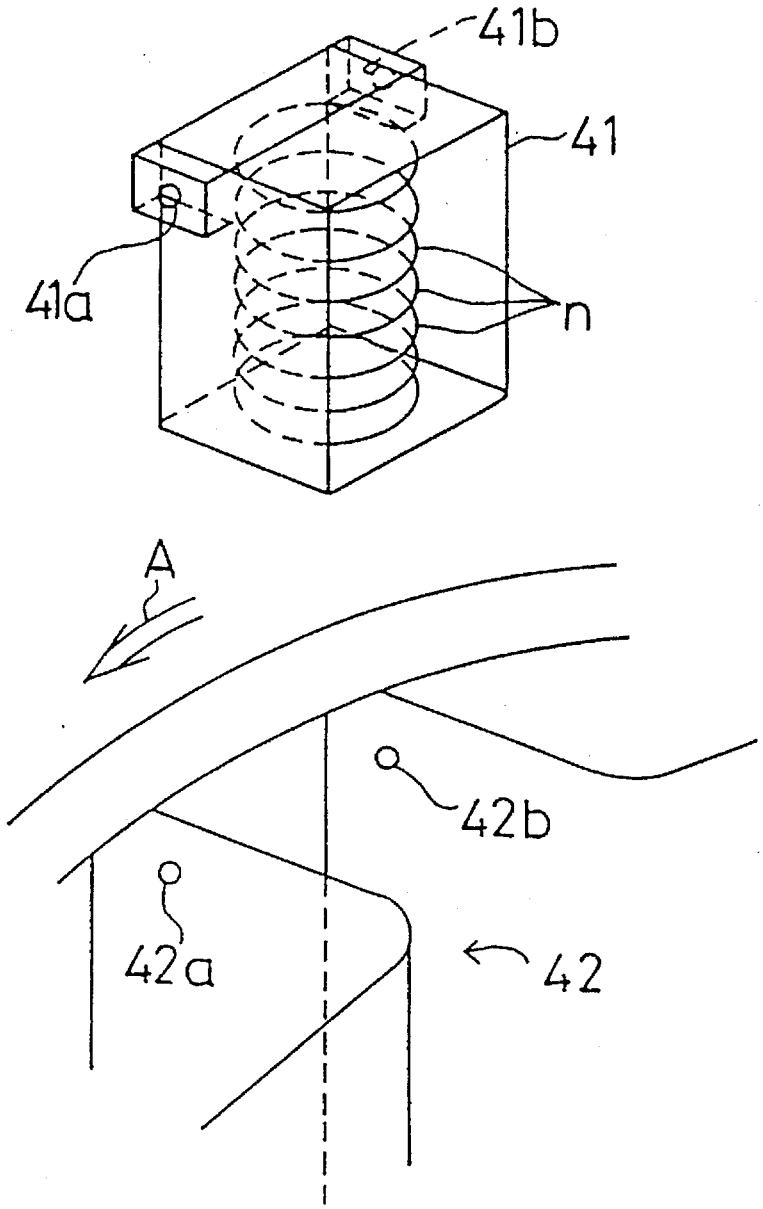
FIG. 5 is an enlarged perspective view of a portion of the downflow spin dryer of FIG. 4, with the cradle detached from the rotor.
Figure 6:
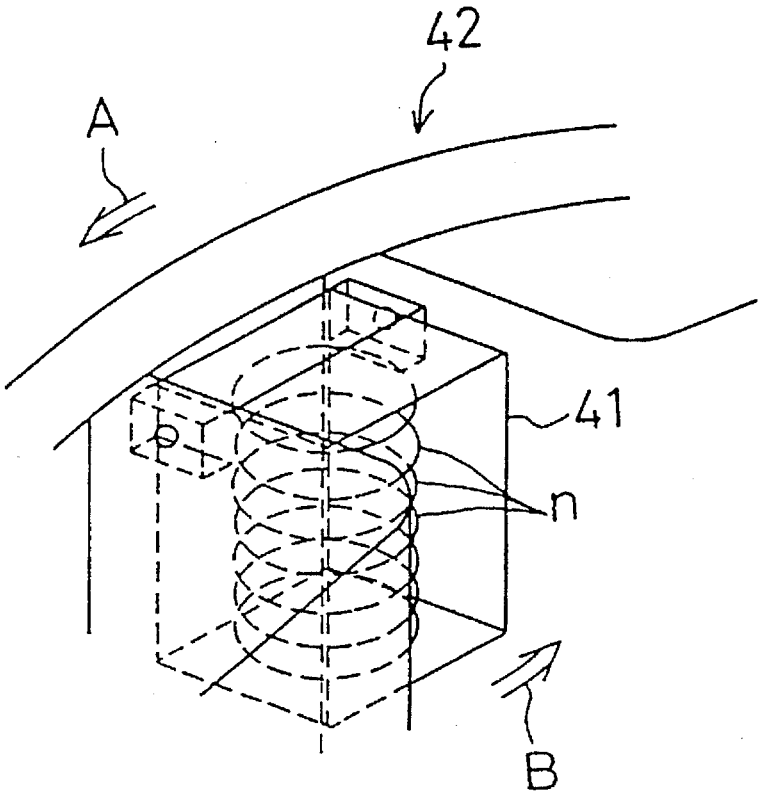
FIG. 6 is an enlarged perspective view of a portion of the downflow spin dryer of FIG. 4, with the cradle mounted in the rotor.

Thus, as shown in FIG. 2, the rotor 12 rotates with the cradle 11 which is mounted diagonally with respect to the rotational direction A of the rotor 12 such that the front of the cradle 11 is high and the rear of the cradle 11 is low.

Because the cradle 11 is mounted diagonally with respect to the rotational direction A, the wafers n are also inclined with respect to the rotational direction A, and when the rotor 12 rotates in the rotational direction A, the wafers n and the cradle 11 act as fins so that a large amount of air is sucked in through the air inlet.

The drying efficiencies of the downflow spin dryer according to the present invention and a conventional downflow spin dryer will now be compared.

When the dryers are run at a maximum speed of 1,000 rpm, the flowrate of air sucked in through the air inlet in the conventional dryer is approximately 20 to 25 m/s, while the flowrate in the dryer of the present invention is faster, at about 40 to 45 m/s. Also, as shown by the table of FIG. 3, when two cradles each containing 25 six-inch silicon wafers washed with pure water were fitted to the rotor and rotated, the time required to dry all 50 of the wafers with the conventional dryer was 5 minutes, whereas with the dryer of the present invention it was shorter, at 3 minutes.

As described above, with an apparatus according to the present invention, a large amount of air can be sucked through the air inlet and items to be dried can be dried in a short period of time.

In the preferred embodiment described above, the cradle was fitted diagonally with respect to the rotational direction of the rotor by the mounting holes on the rotor side being provided at mutually different heights. Alternatively, the cradle may be fitted diagonally with respect to the rotational direction of the rotor by the mounting holes on the rotor side being provided at the same height and the mounting holes on the cradle side being provided at mutually different heights.

According to the present invention, because a cradle for holding items to be dried such as wafers is fitted diagonally or inclined to a rotor so that the front of the cradle is higher than the rear of the cradle with respect to the rotational direction of the rotor, the wafers and the cradle act as fins and a large amount of air is sucked in along with the rotation of the rotor, so that the drying efficiency is good.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A downflow spin dryer, comprising:

a housing;

a rotor rotating within said housing in a direction of rotation;

a cradle fitted within said rotor for accommodating items to be dried, the cradle having a rear portion and a front portion as viewed with respect to said direction of rotation of said rotor, the cradle being fitted to the rotor such that said rear portion of the cradle is at a lower position than said front portion of the cradle;

an air inlet in said housing through which air is sucked along with the rotation of the rotor; and an air outlet in said housing through which air sucked through the air inlet is discharged.

2. A downflow spin dryer according to claim 1, wherein said items to be dried are semiconductor substrates.

3. A downflow spin dryer according to claim 1, wherein said air inlet is in an upper surface of said housing above said rotor.

4. A downflow spin dryer according to claim 1, wherein:

said cradle includes first and second opposite mounting holes, said rotor includes first and second opposite mounting holes in alignment with the first and second mounting holes, respectively, of said cradle when said cradle is fitted within said rotor, and further including screw means for entering said first mounting holes of said cradle and said rotor, and for entering said second mounting holes of said cradle and said rotor, so as to mount said cradle within said rotor.

5. A downflow spin dryer according to claim 1, further comprising a filter over said air inlet to prevent incursion of dust into the dryer.

6. A downflow spin dryer, comprising:

a housing;

a rotor rotating within said housing in a direction of rotation, said rotor including first and second opposite mounting holes;

a cradle fitted within said rotor for accommodating semiconductor substrates to be dried, the cradle having a rear portion and a front portion as viewed with respect to said direction of rotation of said rotor, the cradle being fitted to the rotor such that said rear portion of the cradle is at a lower position than said front portion of the cradle, said cradle including first and second opposite mounting holes in alignment with the first and second mounting holes, respectively, of said rotor when said cradle is fitted within said rotor;

screw means for entering said first mounting holes of said cradle and said rotor, and for entering said second mounting holes of said cradle and said rotor, so as to mount said cradle within said rotor;

an air inlet in said housing through which air is sucked along with the rotation of the rotor; and an air outlet in said housing through which air sucked through the air inlet is discharged.

7. A downflow spin dryer according to claim 6, wherein said air inlet is in an upper surface of said housing above said rotor.

8. A downflow spin dryer according to claim 6, further comprising a filter over said air inlet to prevent incursion of dust into the dryer.

9. A downflow spin dryer, comprising:

a housing;

a rotor rotating within said housing in a direction of rotation, said rotor including first and second opposite mounting holes at different heights;

a cradle fitted within said rotor for accommodating semiconductor substrates to be dried, the cradle having a rear portion and a front portion as viewed with respect to said direction of rotation of said rotor, the cradle being fitted to the rotor such that said rear portion of the cradle is at a lower position than said front portion of the cradle, said cradle including first and second opposite mounting holes in alignment with the first and second mounting holes, respectively, of said rotor when said cradle is fitted within said rotor, said first and second mounting holes of said cradle being at the same height;

screw means for entering said first mounting holes of said cradle and said rotor, and for entering said second mounting holes of said cradle and said rotor, so as to mount said cradle within said rotor;

an air inlet in an upper surface of said housing above said rotor through which air is sucked along with the rotation of the rotor;

an air outlet in said housing through which air sucked through the air inlet is discharged; and a filter over said air inlet to prevent incursion of dust into the dryer.

10. A downflow spin dryer, comprising:

a housing;

a rotor rotating within said housing in a direction of rotation;

a cradle fitted within said rotor for accommodating items to be dried, said cradle having a rear portion and a front portion as viewed with respect to said direction of rotation of said rotor;

said cradle including first mounting holes on one of said front and rear portions and second opposite mounting holes on the other of said front and rear portions;

said rotor including first and second opposite mounting holes in alignment with the first and second mounting holes, respectively, of said cradle when said cradle is fitted within said rotor;

screw means for entering said first mounting holes of said cradle and said rotor, and for entering said second mounting holes of said cradle and said rotor, so as to mount said cradle within said rotor;

said first and second mounting holes of said cradle being at the same height, said first and second mounting holes of said rotor being at different heights such that the cradle is thereby fitted to the rotor with said rear portion of the cradle being at a lower position than said front portion of the cradle;

an air inlet in said housing through which air is sucked along with the rotation of the rotor; and an air outlet in said housing through which air sucked through the air inlet is discharged.

11. A downflow spin dryer, comprising:

a housing;

a rotor rotating within said housing in a direction of rotation;

a cradle fitted within said rotor for accommodating items to be dried, said cradle having a rear portion and a front portion as viewed with respect to said direction of rotation of said rotor;

said cradle including first mounting holes on one of said front and rear portions and second opposite mounting holes on the other of said front and rear portions;

said rotor including first and second opposite mounting holes in alignment with the first and second mounting holes, respectively, of said cradle when said cradle is fitted within said rotor;

screw means for entering said first mounting holes of said cradle and said rotor, and for entering said second mounting holes of said cradle and said rotor, so as to mount said cradle within said rotor;

said first and second mounting holes of said rotor being at the same height, said first and second mounting holes of said cradle being at different heights such that the cradle is thereby fitted to the rotor with said rear portion of the cradle being at a lower position than said front portion of the cradle;

an air inlet in said housing through which air is sucked along with the rotation of the rotor; and an air outlet in said housing through which air sucked through the air inlet is discharged.

12. A downflow spin dryer, comprising:

a housing;

a rotor rotating within said housing in a direction of rotation, said rotor including first and second opposite mounting holes;

a cradle fitted within said rotor for accommodating semiconductor substrates to be dried, the cradle having a rear portion and a front portion as viewed with respect to said direction of rotation of said rotor, said cradle including first and second opposite mounting holes in alignment with the first and second mounting holes, respectively, of said rotor when said cradle is fitted within said rotor, said first and second mounting holes of said cradle being at the same height, said first and second mounting holes of said rotor being at different heights, said cradle being thereby fitted to the rotor with said rear portion of the cradle being at a lower position than said front portion of the cradle;

screw means for entering said first mounting holes of said cradle and said rotor, and for entering said second mounting holes of said cradle and said rotor, so as to mount said cradle within said rotor;

an air inlet in said housing which air is sucked along with the rotation of the rotor; and an air outlet in said housing through which air sucked through the air inlet is discharged.

13. A downflow spin dryer, comprising:

a housing;

a rotor rotating within said housing in a direction of rotation, said rotor including first and second opposite mounting holes;

a cradle fitted within said rotor for accommodating semiconductor substrates to be dried, the cradle having a rear portion and a front portion as viewed with respect to said direction of rotation of said rotor, said cradle including first and second opposite mounting holes in alignment with the first and second mounting holes, respectively, of said rotor when said cradle is fitted within said rotor, said first and second mounting holes of said rotor being at the same height, said first and second mounting holes of said cradle being at different heights, said cradle being thereby fitted to the rotor with said rear portion of the cradle being at a lower position than said front portion of the cradle;

screw means for entering said first mounting holes of said cradle and said rotor, and for entering said second mounting holes of said cradle and said rotor, so as to mount said cradle within said rotor;

an air inlet in said housing which air is sucked along with the rotation of the rotor; and an air outlet in said housing through which air sucked through the air inlet is discharged.

* * * * *